US007252544B2

(12) United States Patent
Wada et al.

(10) Patent No.: US 7,252,544 B2
(45) Date of Patent: Aug. 7, 2007

(54) CONNECTOR HAVING A U-SHAPED FIXING MEMBER WITH SCREW HOLES

(75) Inventors: Takamitsu Wada, Tokyo (JP); Akira Kimura, Tokyo (JP); Hiroki Kamata, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/302,914

(22) Filed: Dec. 14, 2005

(65) Prior Publication Data

US 2006/0128214 A1 Jun. 15, 2006

(30) Foreign Application Priority Data

Dec. 15, 2004 (JP) ..... 2004-362560

(51) Int. Cl.
*H01R 13/73* (2006.01)

(52) U.S. Cl. ..... 439/573

(58) Field of Classification Search ..... 439/573, 439/159, 541.5, 79, 64
See application file for complete search history.

(56) References Cited

U.S. PATENT DOCUMENTS 5,643,001 A * 7/1997 Kaufman et al. ..... 439/159

FOREIGN PATENT DOCUMENTS

JP 162282 6/1994
JP 10289772 10/1998

* cited by examiner

*Primary Examiner*—Alexander Gilman
(74) *Attorney, Agent, or Firm*—Collard & Roe, P.C.

(57) ABSTRACT

In a connector including a contact and a housing holding the contact, a fixing member is coupled to the housing. The fixing member has a pair of facing portions faced to each other in a first direction via a part of the housing. The facing portions are connected to each other by a connecting portion. Screw holes are formed in the facing portions, respectively. Each of the screw holes extends in the first direction.

11 Claims, 6 Drawing Sheets

CONNECTOR HAVING A U-SHAPED FIXING MEMBER WITH SCREW HOLES

This application claims priority to prior Japanese patent application JP 2004-362560, the disclosure of which is incorporated herein by reference.

BACKGROUND OF THE INVENTION

This invention relates to a structure of a connector for use in connecting, for example, a card or the like.

A card connector is used in a mobile apparatus, such as a notebook-type personal computer (PC), a mobile telephone, and a personal digital assistant (PDA). The card connector is disposed at an end portion of an electric or an electronic apparatus in order to facilitate insertion and removal of a card. Depending upon a structure of a housing to which the card connector is mounted and an intended use of the apparatus, use is selectively made of one of two types of card connectors, i.e., a one-slot type adapted to receive one card or a two-slot type adapted to receive two cards.

For example, Japanese Unexamined Patent Application Publication (JP-A) No. H10-289772 discloses a card connector which can be selectively used as the one-slot type and the two-slot type. The card connector is adapted to be mounted to a board such as a printed circuit board and comprises a first connector and a second connector stacked on the first connector. The first and the second connectors are adapted to receive different cards, respectively.

In order to fix the first and the second connectors to the board, use is made of a nut fixed to the second connector and a screw member penetrating the board from its back surface to be engaged with the nut. In this case, no nut is used in the first connector.

However, if the card connector is used as the one-slot type, the nut must be fixed to the first connector. Thus, depending upon whether the card connector is used as the one-slot type or the two-slot type, the nut is fixed to a different object. Therefore, two types of the first connectors with and without the nut are required.

Further, the distance between the board and the nut is different between the one-slot type and the two-slot type. Therefore, an assembly maker of the card connector must provide two different kinds of screw members different in length from each other.

On the other hand, Japanese Unexamined Patent Application Publication (JP-A) No. H6-162282 discloses a card connector in which a two-slot structure is implemented by clamping two card guides using U-shaped metal members and fixing the card guides and the metal members using bolts and nuts.

However, if the two-slot type structure is changed into a one-slot type structure, two different types of screw members different in length must be provided as described above. Thus, the above-mentioned problem is not solved.

Further, proposal is also made of a card connector in which a two-slot type structure is implemented by combining one-slot type structures with U-shaped metal members fixed thereto, respectively. In this case, there is a disadvantage that the different U-shaped metal members must be provided in one-to-one correspondence to the one-slot type structures.

SUMMARY OF THE INVENTION

It is therefore an object of this invention to provide a connector having a simple fixing member for use in mounting the connector and in multiplying the connector and the other.

It is another object of this invention to provide a card connector easily adaptable to a one-slot type structure in which a first connector alone is used and to a two-slot type structure in which a second connector is used in addition to the first connector.

It is still another object of this invention to provide a card connector in which a state where both of first and second connectors are used is easily changed, by removing the second connector, into another state where the first connector alone is used.

Other objects of the present invention will become clear as the description proceeds.

According to an aspect of the present invention, there is provided a connector comprising a contact, a housing holding the contact, and a fixing member coupled to the housing, the fixing member having a pair of facing portions faced to each other in a first direction via a part of the housing, a connecting portion connecting the facing portions to each other, and a pair of screw holes formed in the facing portions, respectively, and extending in the first direction.

DESCRIPTION OF THE PREFERRED EMBODIMENTS

Figure 1:
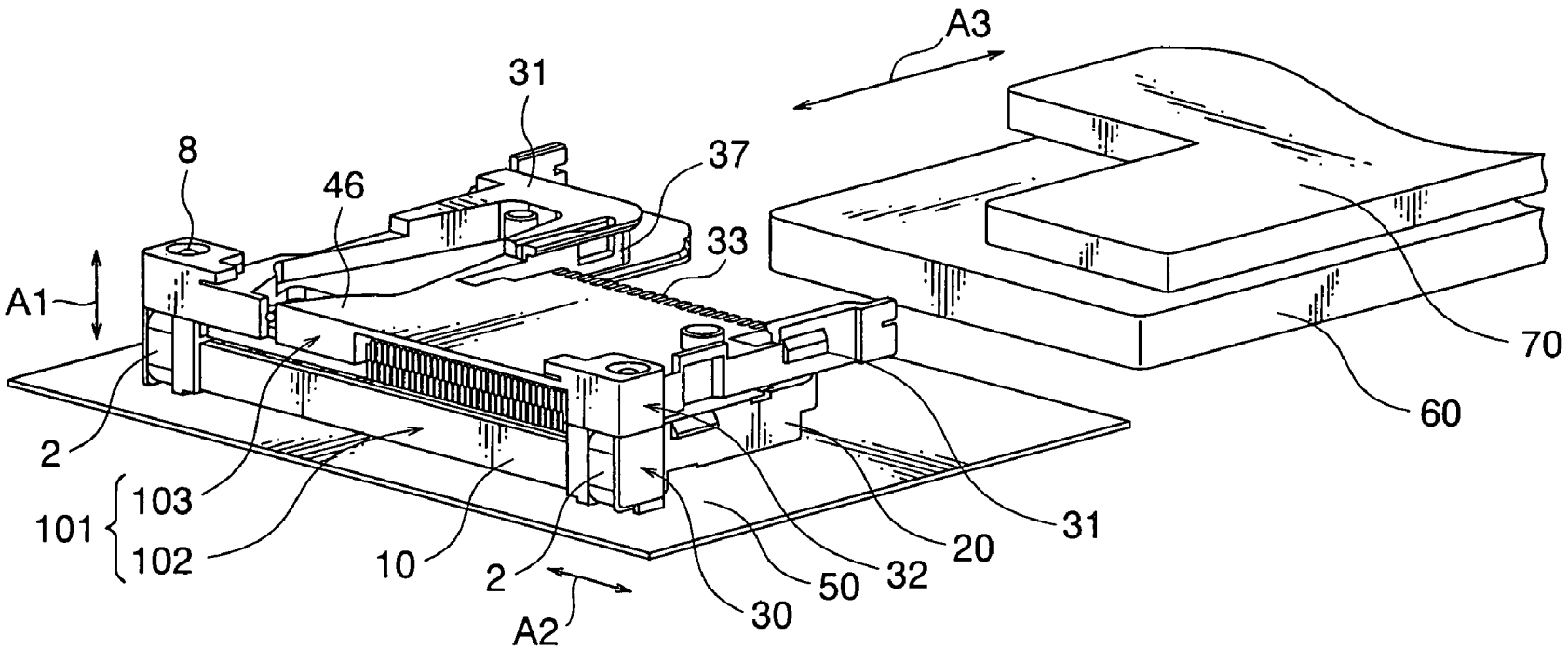
FIG. 1 is a perspective view of a card connector according to a first embodiment of this invention when it is mounted to a board, together with cards to be inserted into the card connector.
Figure 2:
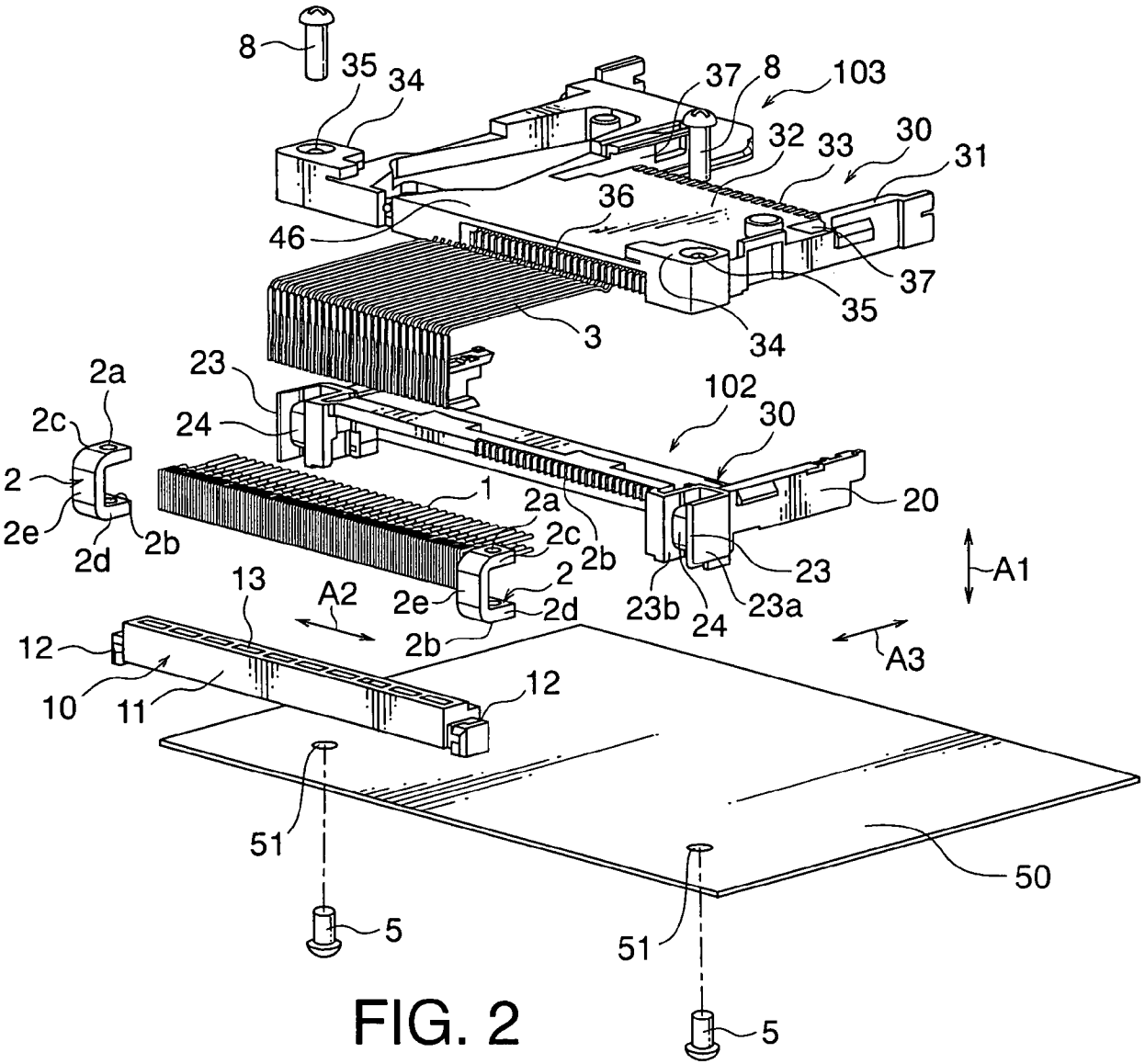
FIG. 2 is an exploded perspective view of the card connector in FIG. 1.
Figure 3:
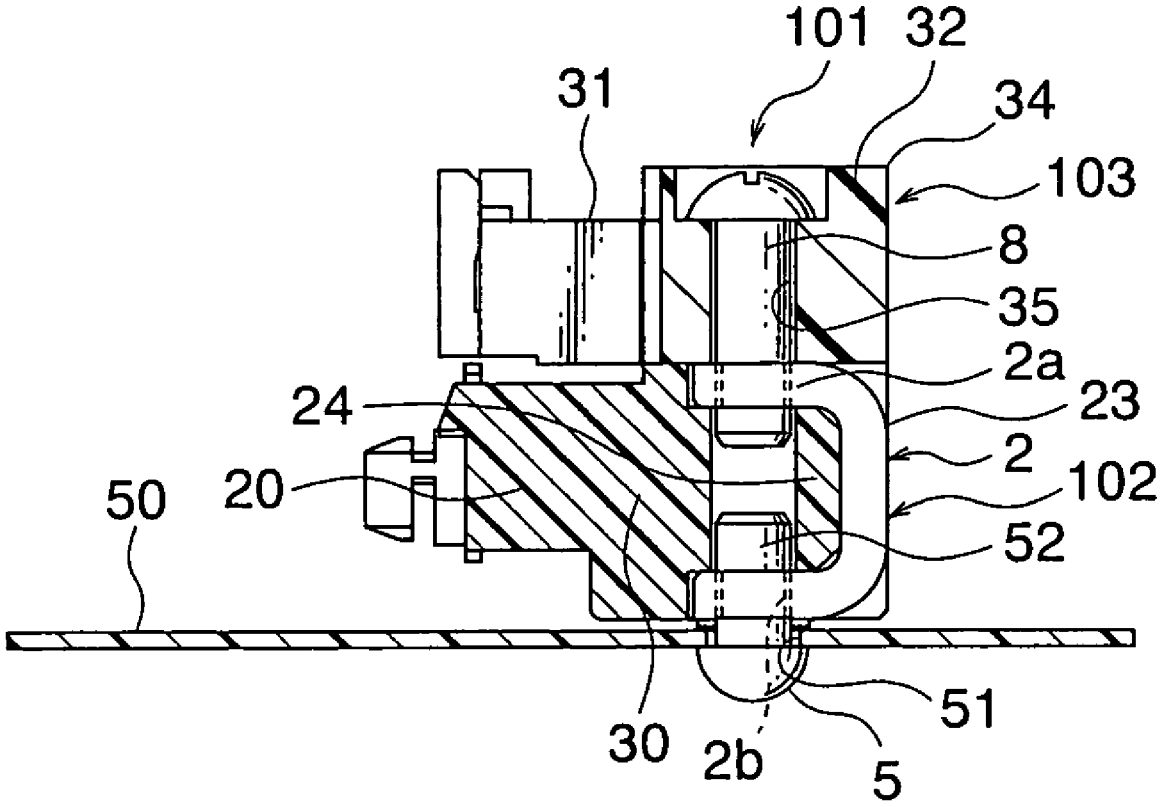
FIG. 3 is a sectional view of a relevant part of FIG. 1.

Referring to FIGS. 1 to 3, description will be made about a card connector according to a first embodiment of this invention.

The card connector depicted by a reference numeral 101 in the figures is of a two-slot type and mounted to a board 50, such as a printed circuit board, as a connection object. The card connector 101 comprises a first (lower) connector 102 adapted to receive a first card 60, such as an IC card, a PC card, or a memory card, and a second (upper) connector 70 stacked on the first connector 102 and adapted to receive a second card 70, such as an IC card, similar to the first card 60. Thus, the first and the second connectors 102 and 103 are stacked on the board 50 in a vertical direction, i.e., a first direction A1.

The first connector 102 comprises a housing 30 including a base portion 10 and a frame portion 20 coupled to the base portion 10. The frame portion 20 is provided with a pair of U-shaped holding portions 23 formed on a rear surface thereof at opposite sides in a transversal direction, i.e., a second direction A2. Each of the holding portions 23 has a pair of wall portions 23*a* and 23*b* defining an opening or a space therebetween. In the opening of each holding portion 23, a fitting portion 24 is disposed to receive a fixing metal member 2 as a fixing member.

The fixing metal member 2 has tapping holes, i.e., screw holes 2*a* and 2*b* faced to each other in the first direction A1. The screw holes 2*a* and 2*b* are formed on a pair of facing portions 2*c* and 2*d* faced to each other in the first direction A1. The facing portions 2*c* and 2*d* are connected to each other by a connecting portion 2*e*. In the illustrated example, a combination of the facing portions 2*c* and 2*d* and the connecting portion 2*e* forms a U shape.

The base portion 10 has a base main body 11 having a plurality of receiving holes 13 for receiving terminal portions of a plurality of contacts 1 of the first connector 102 and a plurality of contacts 3 of the second connector 103, and a pair of protruding engaging portions 12 formed at opposite ends of the base main body 11 in the second direction A2 to be received and locked by the holding portions 23 of the frame portion 20. The frame portion 20 has a contact receiving portion 26 formed by a plurality of holes and grooves for receiving the contacts 1.

The contacts 1 are received in the contact receiving portion 26 and aligned by the base portion 10. The contacts 1 may be integrally formed with the base portion 10 and/or the frame portion 20. In other words, the contacts 1 may be molded in the base portion 10 or the frame portion 20 by insert molding known in the art. Alternatively, the frame portion 20 is provided with comb-like grooves and through holes formed at its center to receive the terminal portions of the contacts 1 inserted therethrough.

The second connector 103 comprises a housing 32 supporting the contacts 3. The housing 32 comprises a frame portion 31 having a recess of a shape corresponding to the card, and a base portion 46 coupled to the frame portion 31. The frame portion 31 is provided with a pair of guide grooves 37 formed on opposite sides of the recess to guide the card. The frame portion 31 has a coupling portion 33 formed on a bottom side of the recess and having a patterned indented edge known in the art. The base portion 46 has a contact receiving portion 36 formed on one side of its rear surface and formed by a plurality of holes and grooves for receiving the contacts 3.

The housing 32 has a pair of holding portions 34 formed at opposite corners on its rear side and having through holes 35, respectively. As will later be described, the through holes 35 serve to couple the second connector 103 to the first connector 102. The board 50 has a plurality of through holes 51 for insertion of a plurality of screw members 5 for fixing the card connector 101.

Now, the description will be made of a method of assembling a connector assembly in which the first and the second connectors 102 and 103 are stacked on and fixed to the board 50.

At first, one end portions of the contacts 1 are fitted into the contact receiving portion 26 of the frame portion 20. Then, the base portion 10 is received in the frame portion 20 so that the engaging portions 12 are engaged with the holding portions 23. In this event, the other portions of the contacts 1 may be engaged with the base portion 10.

Next, one end portions of the contacts 3 are inserted into the contact receiving portions 36 of the base portion 46. Further, the other end portions of the contacts 3 are inserted into the receiving holes 13 of the base portion 10 from an upper surface thereof.

In this state, the first and the second connectors 102 and 103 are stacked on the board 50 in a two-tier structure. Thereafter, the two fixing metal members 2 are press-fitted to the holding portions 23, respectively. Specifically, the fixing metal members 2 are fitted to the fitting portions 24 so that each of the fitting portions 24 is located between the facing portions 2*c* and 2*d*. As best shown in FIG. 3, screw members 8 and the screw members 5 are screwed from the above and the below into the screw holes 2*a* and 2*b* of the fixing metal members 2 via the through holes 35 and 51 to be tightened and fixed, respectively.

The first card 60 is inserted and removed with respect to the first connector 102 in a third direction A3 perpendicular to the first and the second directions A1 and A2.

In the above-mentioned card connector 101 of a two-slot type, the first connector 102 is fixed to the board 50 by the screw holes 2*b* formed on lower surfaces of the fixing metal members 2 and the screw members 5. The second connector 103 is fixed to the first connector 102 by the screw holes 2*a* formed on upper surfaces of the fixing metal members 2 and the screw members 8. Therefore, merely by removing the screw members 8, the second connector 103 is removed from the first connector 102 to form a one-slot type card connector.

In either of the two-slot type and the one-slot type, the card connector can be fixed to the board 50 by the use of the screw members 5 of the same length. Thus, it is sufficient to provide the first connector 102 of a single kind.

As described above, an assembly maker can provide the card connector requiring a single kind of screw members without changing the length of the screw members for fixing the board and the card connector either in case where the card connector is used as the one-slot type including the lower connector alone or in case where the card connector is used as the two-slot type including the upper and the lower connectors.

In order to form the one-slot type, the upper and the lower connectors is separated from each other by removing the screw members fixing the upper connector to the lower connector. After separating the upper connector, the lower connector alone can be used. Thus, it is sufficient to provide a single kind of the lower card connector.

Figure 4:
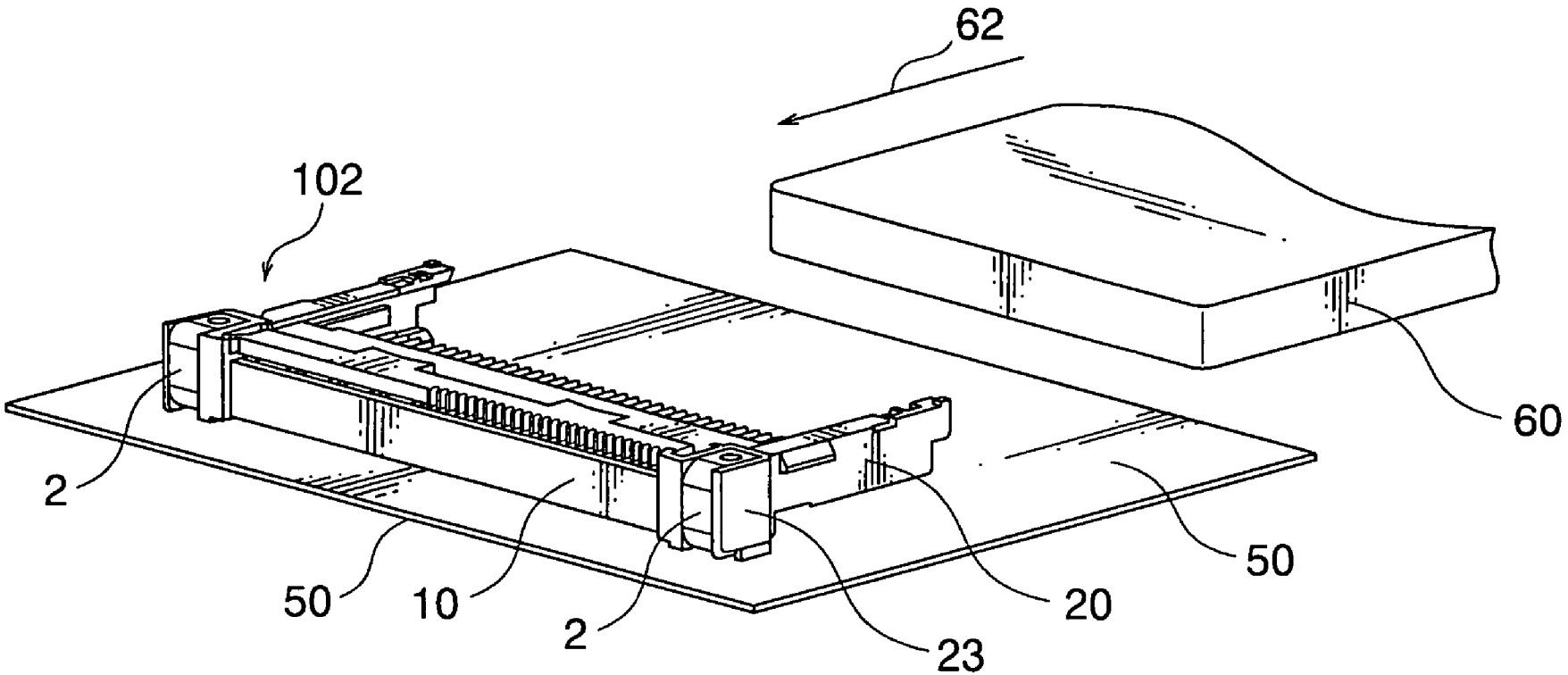
FIG. 4 is a perspective view of a card connector according to a second embodiment of this invention when it is mounted to a board, together with cards to be inserted into the card connector.
Figure 5:
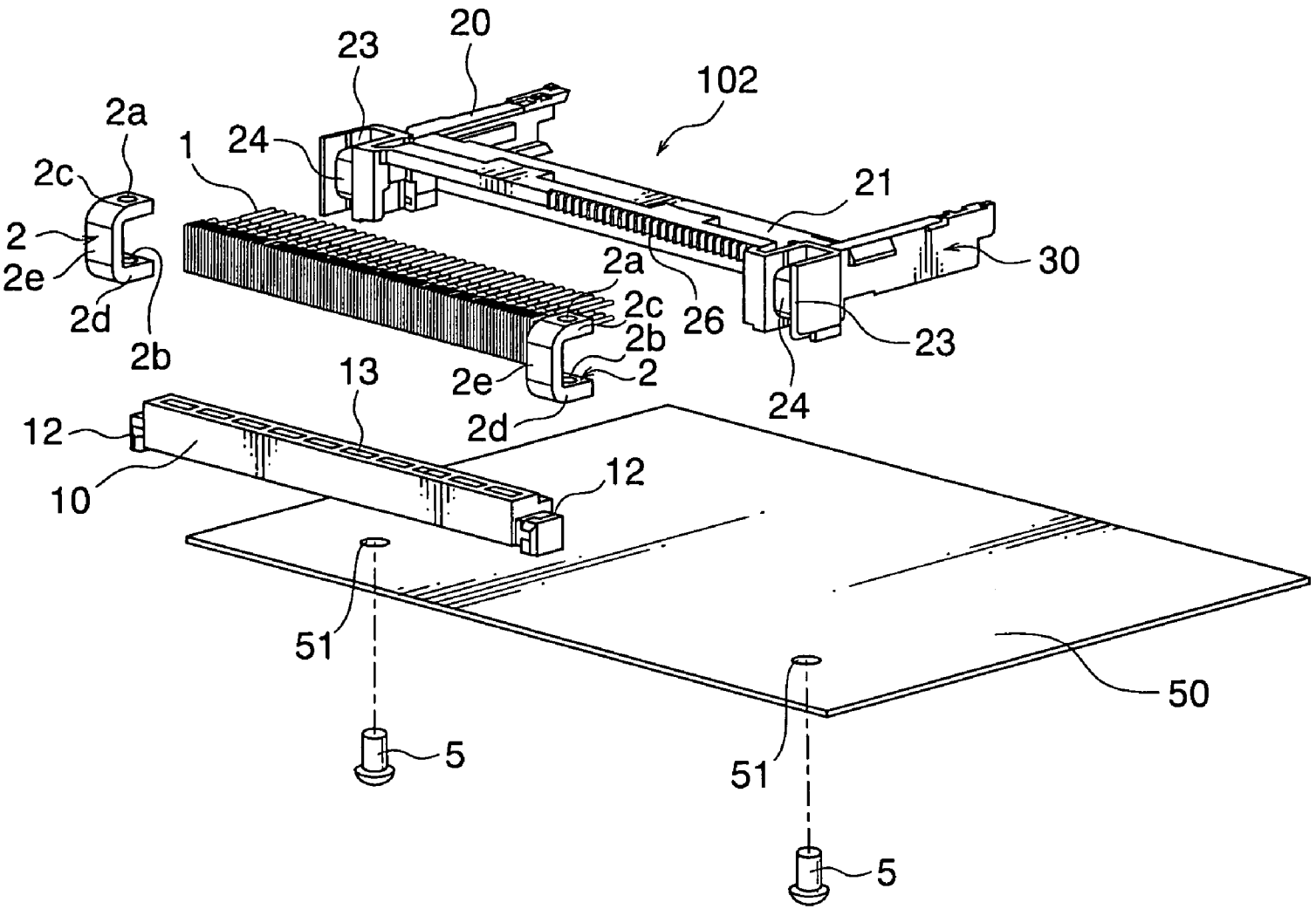
FIG. 5 is an exploded perspective view of the card connector in FIG. 4.
Figure 6:
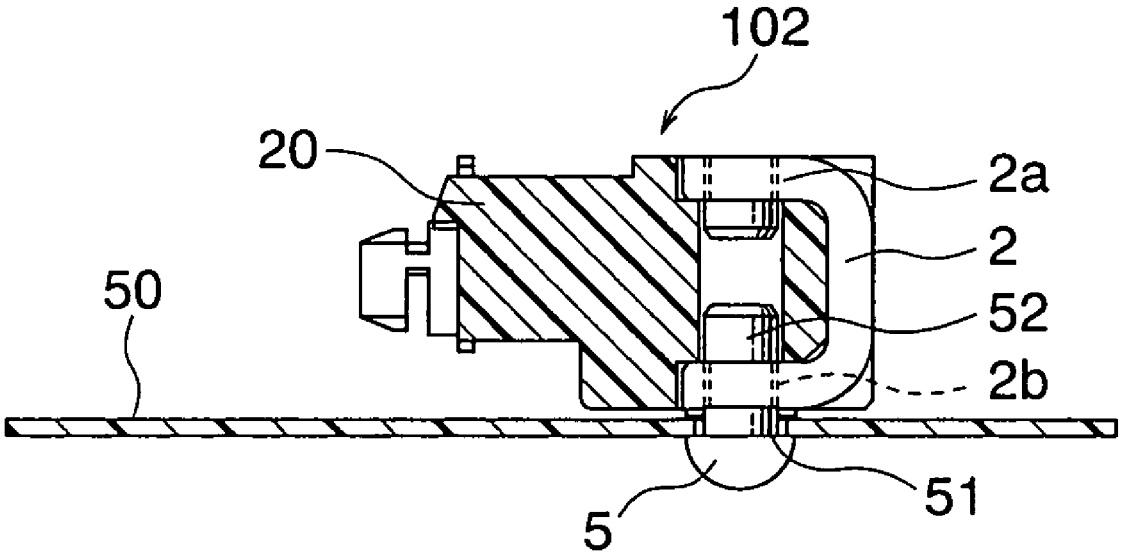
FIG. 6 is a sectional view of a relevant part of FIG. 4.

Referring to FIGS. 4 to 6, a card connector according to a second embodiment of this invention will be described.

The card connector illustrated in the figures is of a one-slot type mounted to the board 50, such as a printed circuit board, as a connection object. The card connector comprises only the first connector 102 in the card connector shown in FIGS. 1 through 3 and is therefore depicted by the same reference numeral 102. Similar parts are designated by like reference numerals and description thereof will be omitted.

The card connector 102 of the second embodiment is assembled in the manner similar to the first connector 102 described in conjunction with FIGS. 1 through 3. Briefly speaking, the contacts 1 are fitted to the frame portion 20 and the frame portion 20 is fixed to the base portion 10. Next, the card connector 102 is placed on the board 50. Then, the through holes 51 and the screw holes 2*b* are aligned. The screw members 5 are inserted into the through holes 51 from a back surface of the board 50 and screwed into the screw holes 2*b* to be tightened. Thus, the card connector 102 is fixed to the board 50 by screw fastening using the U-shaped fixing metal members 2 press-fitted to the fitting portions 24 formed on the frame portion 20 of the housing 30.

The above-mentioned card connector is suitable for use in a mobile apparatus, such as a notebook-type personal computer (PC), a mobile telephone, and a personal digital assistant (PDA).

Although this invention has been described in conjunction with a few preferred embodiments thereof, this invention may be modified in various other manners. For example, although the foregoing description is directed to the card connector using the card, such as the IC card, as a connection object, this invention is also applicable to a connector using other connection objects, such as a printed circuit board. The connector may be mounted directly on an electronic apparatus or the like. Although a number of contacts are used in each of the illustrated examples, this invention is applicable to a connector using at least one contact.

What is claimed is:

1. A connector comprising:

a contact;

a housing holding the contact; and a fixing member coupled to the housing;

the fixing member having:

a pair of facing portions faced to each other in a first direction via a part of the housing;

a connecting portion connecting the facing portions to each other; and a pair of screw holes formed in the facing portions, respectively, and extending in the first direction;

wherein the housing has a base portion positioning the contact, and wherein the base portion extends long in a second direction perpendicular to the first direction and has an engaging portion formed at each of opposite ends in the second direction to be engaged with the holding portion.

2. The connector according to claim 1, wherein a combination of the facing portions and the connecting portion has a U shape.

3. A connector assembly comprising:

a connector according to claim 1;

a board faced to one end of the connector in a first direction; and a screw member penetrating through the board to be screwed into a screw hole formed on one of the facing portions.

4. The connector assembly according to claim 3, further comprising:

an additional connector faced to the one end of the connector in the first direction; and an additional screw member penetrating through the additional connector to be screwed into a screw hole formed on the other of the facing portions.

5. The connector according to claim 1, wherein the housing has, as the part, a fitting portion disposed between the facing portions.

6. The connector according to claim 5, wherein the fitting portion has a through hole communicating with the screw holes and extending in the first direction.

7. The connector according to claim 6, wherein the housing has:

a frame portion coupled to the base portion and adapted to guide a card;

the fitting portion being formed on the frame portion.

8. The connector according to claim 7, wherein the frame portion includes a holding portion having a pair of wall portions faced to each other in the second direction, the fitting portion being disposed between the wall portions.

9. The connector according to claim 8, wherein the frame portion extends long in the second direction, the holding portion and the fitting portion are located at each of opposite ends of the frame portion in the first direction.

10. The connector according to claim 7, wherein the base portion is removable from the frame portion.

11. The connector according to claim 7, wherein the frame portion has a structure allowing passage of the contact in a third direction perpendicular to the first and the second directions.

* * * * *